US006286942B1

(12) United States Patent
Miyazawa et al.

(10) Patent No.: US 6,286,942 B1
(45) **Date of Patent: *Sep. 11, 2001**

(54) INK JET RECORDING HEAD WITH MECHANISM FOR POSITIONING HEAD COMPONENTS

(75) Inventors: Hisashi Miyazawa; Takashi Nakamura; Osamu Nakamura; Shinji Yasukawa; Minoru Usui; Tomoaki Abe; Satoru Hosono; Takahiro Naka, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/070,766

(22) Filed: May 1, 1998

Related U.S. Application Data

(60) Division of application No. 08/469,504, filed on Jun. 6, 1995, now Pat. No. 5,764,257, and a continuation-in-part of application No. 08/179,687, filed on Jan. 11, 1994, and a continuation-in-part of application No. 08/098,934, filed on Jul. 29, 1993, said application No. 08/469,504, is a continuation-in-part of application No. 07/997,571, filed on Dec. 28, 1992, now Pat. No. 5,517,225, said application No. 08/098,934, is a continuation-in-part of application No. 07/997,571, said application No. 08/179,687, is a continuation-in-part of application No. 07/997,571.

(30) Foreign Application Priority Data

| | | |
|---|---|---|
| Dec. 26, 1991 | (JP) | 3-345343 |
| Feb. 7, 1992 | (JP) | 4-22833 |
| Feb. 12, 1992 | (JP) | 4-25126 |
| Mar. 3, 1992 | (JP) | 4-45195 |
| Apr. 6, 1992 | (JP) | 4-84003 |
| Apr. 22, 1992 | (JP) | 4-103059 |
| Apr. 22, 1992 | (JP) | 4-103060 |

(51) Int. Cl.[7] ..... B41S 2/045

(52) U.S. Cl. ..... 347/68

(58) Field of Search ..... 347/68, 74, 71, 347/72

(56) References Cited

U.S. PATENT DOCUMENTS

| | | | |
|---|---|---|---|
| 4,095,232 | 6/1978 | Cha . | |
| 4,434,430 | 2/1984 | Koto | 347/70 |
| 4,439,780 | 3/1984 | DeYoung et al. . | |
| 4,599,628 | 7/1986 | Doring et al. | 346/140 |
| 4,730,196 | 3/1988 | Van Esdonk et al. | 346/140 |

(List continued on next page.)

FOREIGN PATENT DOCUMENTS

| | | |
|---|---|---|
| 0024955 | 9/1979 | (EP) . |
| 0 126 649 | 11/1984 | (EP) . |

(List continued on next page.)

OTHER PUBLICATIONS

Patent Abstracts of Japan; Publication No. JP3234538; Abstracts Publication Date Jan. 16, 1992.

Patent Abstracts of Japan; 61–283552; Date Dec. 13, 1986.

Patent Abstracts of Japan; Publication No. JP3073347; Abstracts Publication Date Jun. 17, 1991.

*Primary Examiner*—Benjamin R. Fuller
*Assistant Examiner*—C. Dickens
(74) *Attorney, Agent, or Firm*—Sughrue, Mion, Zinn, Macpeak & Seas, PLLC

(57) ABSTRACT

In an ink jet recording head, after a plate-shaped piezoelectric element is positioned and fixed onto a fixing plate, the piezoelectric element is sliced into a large number of vibrators and the leading ends of the vibrators are embracingly held in positioning holes 33 respectively formed in a top surface of a holding frame and are thus positioned in the surface direction thereof. Further, a cavity unit is positioned and fixed on the top surface of the holding frame.

11 Claims, 13 Drawing Sheets

U.S. PATENT DOCUMENTS

| | | | | |
|---|---|---|---|---|
| 4,768,266 | | 9/1988 | DeYoung | 346/140 |
| 4,779,099 | | 10/1988 | Lewis | 346/1.1 |
| 4,937,589 | | 6/1990 | Fagerquist et al. . | |
| 5,072,240 | | 12/1991 | Miyazawa et al. | 346/140 |
| 5,446,485 | | 8/1995 | Usui et al. | 347/72 |
| 5,510,816 | | 4/1996 | Hosono et al. | 347/10 |
| 5,517,225 | | 5/1996 | Miyazawa et al. | 347/71 |
| 5,604,522 | | 2/1997 | Miura et al. | 347/70 |
| 5,610,643 | | 3/1997 | Kutami et al. | 347/54 |
| 5,650,810 | * | 7/1997 | Muto | 347/671 |
| 5,764,257 | * | 6/1998 | Miyazawa et al. | 347/71 |

FOREIGN PATENT DOCUMENTS

| | | |
|---|---|---|
| 0126649 | 11/1984 | (EP) . |
| 2257356 | 12/1974 | (FR) . |
| 58119870 | 7/1983 | (JP) . |
| 58119871 | 7/1983 | (JP) . |
| 608953 | 3/1985 | (JP) . |
| 60-90770 | 5/1985 | (JP) . |
| 61283553 | 12/1986 | (JP) . |
| 63-130350 | 6/1988 | (JP) . |
| 245985 | 10/1990 | (JP) . |
| 252625 | 11/1990 | (JP) . |
| 3272857 | 4/1991 | (JP) . |
| 3073347 | 6/1991 | (JP) . |
| 3-234538 | 10/1991 | (JP) . |
| 3264360 | 11/1991 | (JP) . |
| 3-281252 | 12/1991 | (JP) . |
| 3-288647 | 12/1991 | (JP) . |
| 3234538 | 1/1992 | (JP) . |
| 4163050 | 6/1992 | (JP) . |
| 4179552 | 6/1992 | (JP) . |

OTHER PUBLICATIONS

Patent Abstracts of Japan; Publication No. JP3272857; Abstracts Publication Date Dec. 4, 1991.
Patent Abstracts of Japan; Publication No. JP63235646; Abstracts Publication Date November 2, 1988.
Patent Abstracts of Japan; Publication No. JP2220848; Abstracts Publication Date Sep. 4, 1990.
Patent Abstracts of Japan; Publication No. JP2277640; Abstracts Publication Date Jun. 8, 1990.
Patent Abstracts of Japan; Publication No. JP2150354; Abstracts Publication Date Jun. 8, 1990.
Patent Abstracts of Japan; Publication No. 59–162061; Abstracts Publication Date Sep. 12, 1984.
Patent Abstracts of Japan, vol. 011, No. 149 (M–588) (May 1987) as it relates to JP 61 283553 (Dec. 1986).
Patent Abstracts of Japan, vol. 015, No. 235 (M–1125) (Jun. 1991) as it relates to JP 03 073347 (Mar. 1991).
Patent Abstracts of Japan, vol. 013, No. 060 (M–796) (Feb. 1989) as it relates to JP 63 265646 (Nov. 1988).
Patent Abstracts of Japan, vol. 014, No. 523 (M–1049) (Nov. 1990) as it relates to JP 02 220848 (Sep. 1990).
Patent Abstracts of Japan, vol. 016, No. 090 (M–1218) (Mar. 1992) as it relates to JP 03 272857 (Dec. 1991).
Patent Abstracts of Japan, vol. 016, No. 016 (M–1200) (Jan. 1992) as it relates to JP 03 234538 (Oct. 1991).
Patent Abstracts of Japan, vol. 009, No. 014 (M–352) (Jan. 1985) as it relates to JP 59 162061 (Sep. 1984).

* cited by examiner

D
5
73
12
11
33
32
38
36
2
1
3
27
31
9
28
29

INK JET RECORDING HEAD WITH MECHANISM FOR POSITIONING HEAD COMPONENTS

This is a divisional of application Ser. No. 08/469,504 filed Jun. 6, 1995, now U.S. Pat. No. 5,764,257 which is a Continuation-in-Part of application Ser. No. 07/997,571 filed Dec. 28, 1992 now U.S. Pat. No. 5,517,225; application Ser. No. 08/098,934 filed Jul. 29, 1993, which is a Continuation-in-Part of application Ser. No. 07/997,571 filed Dec. 28, 1992; and application Ser. No. 08/179,687 filed Jan. 11, 1994, which is a Continuation-in-Part of application Ser. No. 07/997,571 filed Dec. 28, 1992 now U.S. Pat. No. 5,517,225.

BACKGROUND OF THE INVENTION

1. Field of the Invention

The present invention relates to an ink jet recording head for use in an ink jet recording device which ejects drops of ink to thereby form an image and, more particularly, to an ink jet recording head having a mechanism for precisely positioning the respective components of the head.

2. Description of the Related Art

Japanese Patent Unexamined Publication No. Sho 58-119870 discloses an ink jet recording head employing a piezoelectric vibrator which moves in the longitudinal direction to apply pressure to ink stored within a pressure chamber, and the pressurized ink is then jetted out from a nozzle as droplets of ink onto a recording medium.

In the recording head of the above-mentioned type, a large number of piezoelectric vibrators are inserted into guide holes formed in the upper and lower portions of a support member to thereby position and support the respective base end portions and leading end portions thereof. However, in this structure, the piezoelectric vibrators cannot be disposed in a high density arrangement. Also, they may be unevenly in the longitudinal direction thereof, and may be inclined with respect to each other, which makes it impossible to provide a uniform ink jet characteristic

SUMMARY OF THE INVENTION

The present invention is directed to eliminating the drawbacks found in the above-mentioned known recording heads. Accordingly, it is an object of the invention to provide a new ink jet recording head which is capable of positioning and connecting a plurality of piezoelectric vibrators, as well as various components forming the recording head, with respect to one another with high accuracy.

In attaining the above, object, according to the invention, after a plate-shaped piezoelectric element is previously positioned and fixed onto a fixing plate, the piezoelectric element is divided into a plurality of piezoelectric vibrators, and piezoelectric vibrators are held and positioned in the surface direction thereof by a holding device.

According to another aspect of the invention, the outermost piezoelectric vibrators are used as vibrator-positioning members to thereby enhance the working accuracy of the remaining vibrators used for ink jetting. Also, the vibrator-positioning member vibrators are used for positioning the vibrators with respect to the holding device or an ink flow passage substrate.

According to still another aspect of the invention, a pressure chamber in a flow passage substrate is formed in such a manner that both side portions thereof respectively define a planar surface, and the vibrator-positioning members are respectively opposite to these planar side portions of the ink flow passage substrate, thereby enhancing the positioning accuracy between the ink flow passage forming substrate and the piezoelectric vibrators in the displacement direction thereof.

According to a further aspect of the invention, positioning projections respectively provided on both sides of the fixing plate, which serve as a positioning reference for the piezoelectric vibrators, are used as the positioning portions that position the ink flow passage substrate in the surface direction thereof, so that the piezoelectric vibrators and the ink flow passage substrate can be positioned directly.

DETAILED DESCRIPTION OF THE PREFERRED EMBODIMENTS

Figure 1:
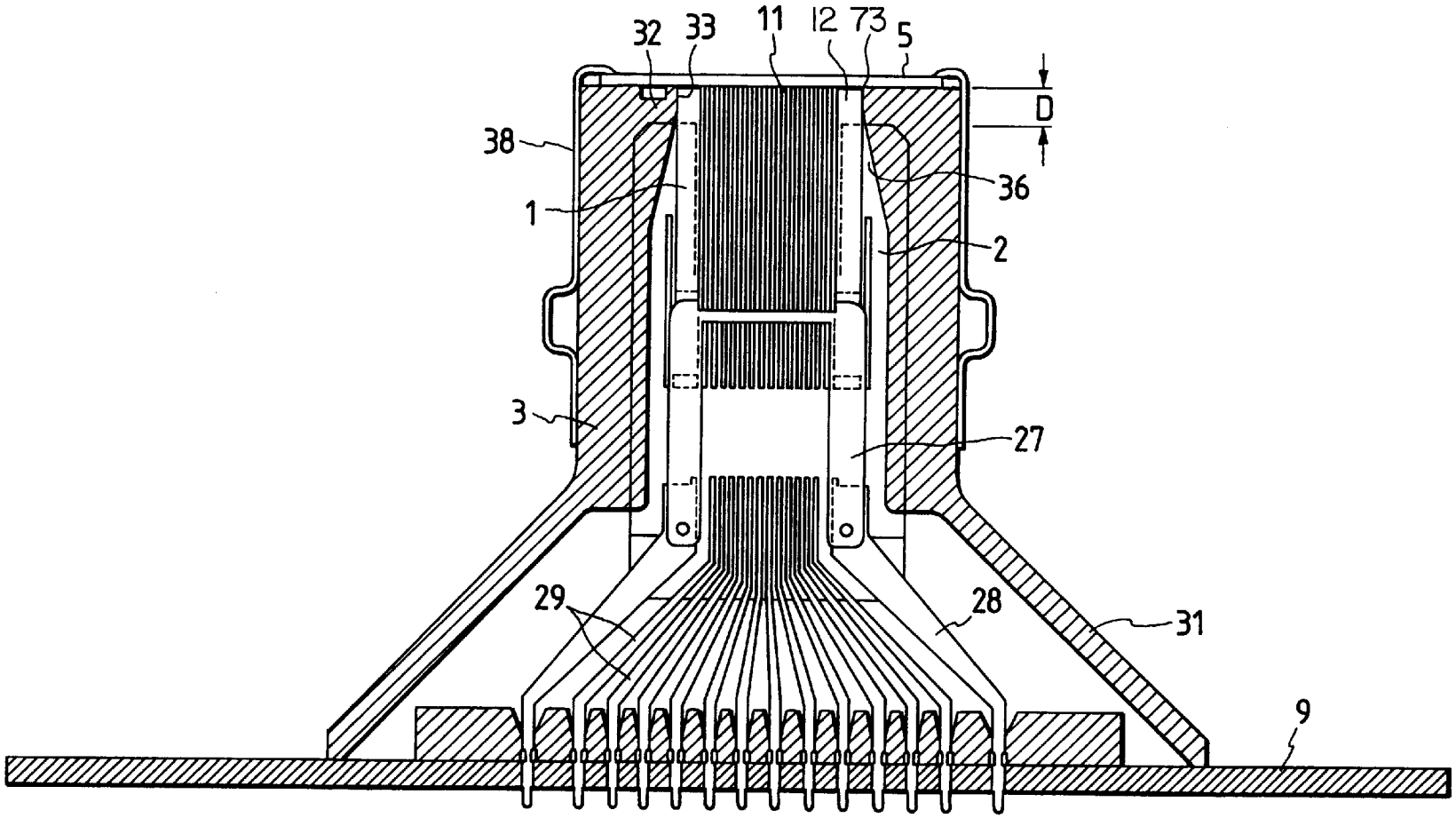
FIG. 1 is a sectional side view of an ink jet recording head according to a first embodiment of the invention.
Figure 2:
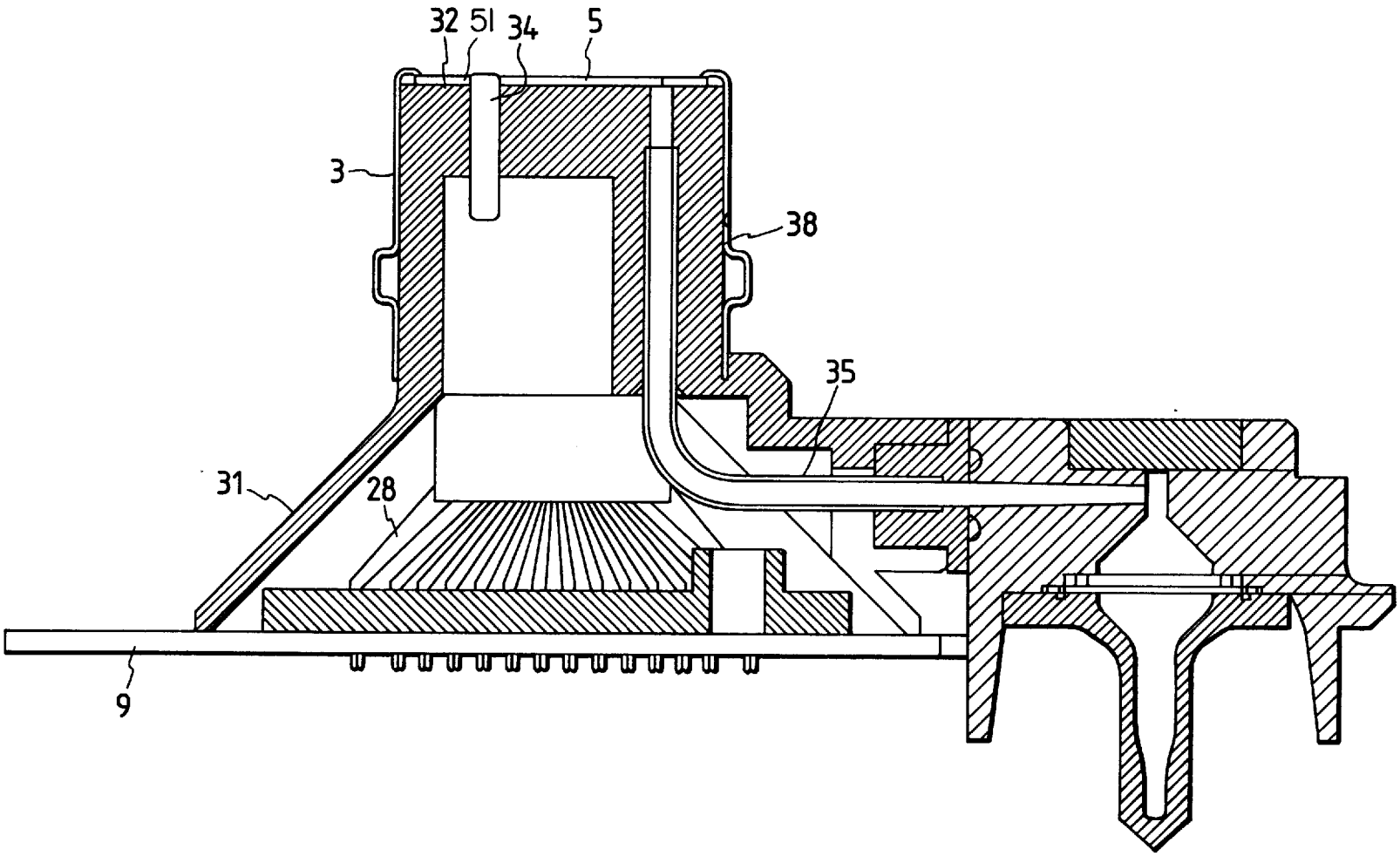
FIG. 2 is a sectional side view of the ink jet recording head of FIG. 1, taken from the position of a pin 34.
Figure 3A:
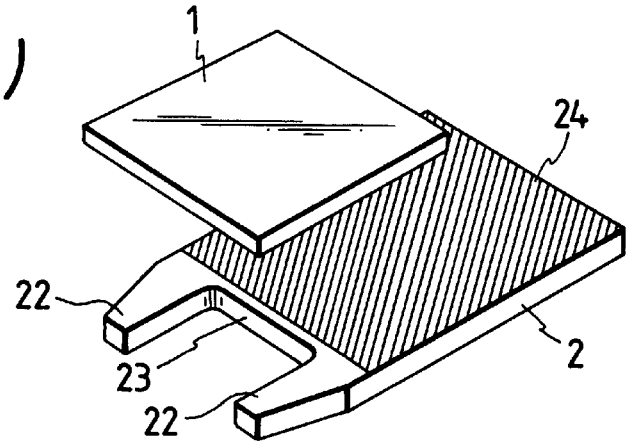
FIGS. 3(*a*) to 3(*d*) are views of a piezoelectric element and a fixing plate, respectively showing steps of producing the piezoelectric vibrators.
Figure 3B:
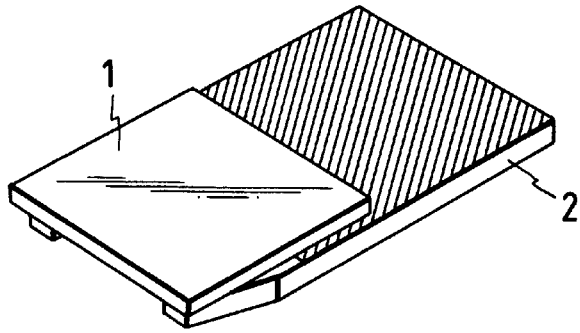
Figure 3C:
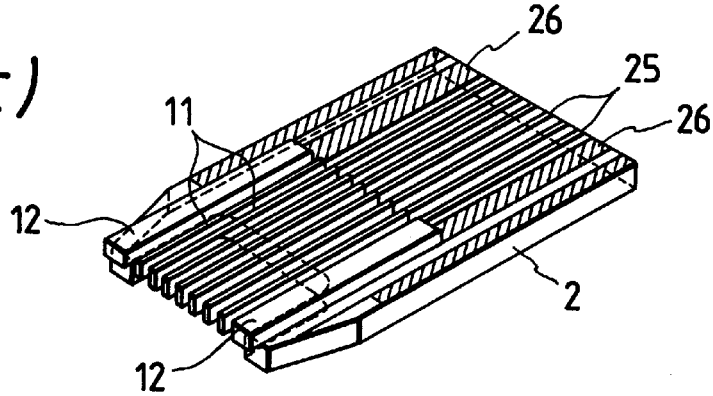
Figure 3D:
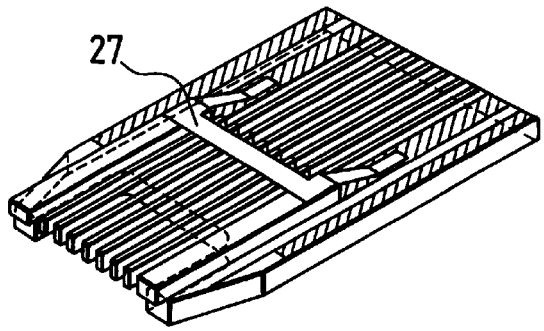

FIGS. 1 and 2 illustrate an ink jet recording head according to a first embodiment of the invention. The ink jet recording head includes a plate-shaped lamination-type piezoelectric element 1 which, as will be described later, is cut into rectangular pieces which are mounted on a fixing plate 2 to provide a large number of vibrators 11. A holding frame 3 holds the vibrators 11 and positions them in the surface direction of a cavity unit 5. The cavity unit 5 is positioned and held onto the holding frame 3 by a positioning pin 34. Reference numeral 38 denotes a cover which supports the outer peripheral portion of the cavity unit 5. Reference numerals 28 and 29 designate a lead frame and a lead wire, respectively; and reference numeral 9 indicates a head circuit board.

Figure 4:
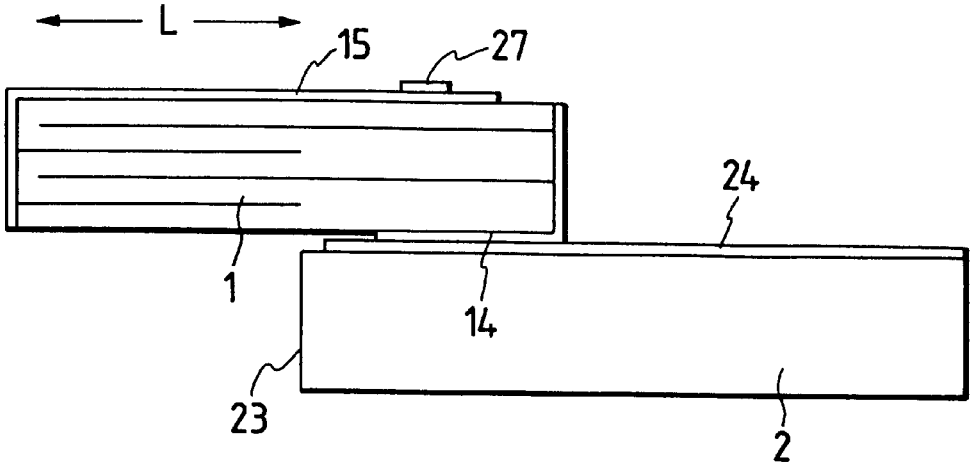
FIG. 4 is an explanatory view of a connection relationship between a piezoelectric vibrator and a fixing plate.

FIGS. 3(*a*) to 3(*d*) and 4 illustrate the piezoelectric element 1 and fixing plate 2. The fixing plate 2 is formed of free-cutting ceramics or the like, and includes an electrode 24 on the top surface thereof. The fixing plate 2 is substantially U-shaped having positioning portions 22 protruding from both ends thereof. The plate-shaped piezoelectric element 1 has an electrode 14 on the lower surface and the rear end face thereof (see FIG. 4). The piezoelectric element 1 is firmly adhered to the fixing plate 2 in such a manner that the leading edge of the piezoelectric element 1 extends from an edge 23 by a predetermined length for defining a constant active length L of the resulting vibrators. Also, the electrode 14 on the lower surface of the element 1 is in contact with the electrode 24 of the fixing plate 2.

The piezoelectric element 1 is formed to have a width which is greater than the length of a corresponding nozzle array. After it is fixed to the fixing plate 2, the piezoelectric element 1 is sliced into a plurality of vibrators 11, and two vibrator-positioning members 12. The pitch between vibrators 11 corresponds to the pitch of nozzles 61 (see FIG. 6). A slicing machine, such as a wire saw or the like (see FIG. 3(*c* )), is used to form vibrators 11. In this case, two rectangular parts respectively formed on the two outermost sides of these vibrators 11 are used as vibrator-positioning members 12. The vibrator positioning members 12 serve to absorb any deformation of the two side ends of the vibrators which occurs during the slicing operation, and to protect the thin vibrators 11.

Also, the electrode 24, disposed on the surface of the fixing plate 2 whose positioning member 22 serves to supplement the vibrator-positioning members 12, is cut into a large number of signal electrodes 25, which respectively correspond to the vibrators 11, during the slicing operation. The signal electrodes 25 are connected to respective lead wires 29, and lead wires 29 are connected to the head circuit board 9 (see FIG. 1). On the other hand, two common electrodes 26 are respectively connected to the lead frames 28 which extend to the head circuit board 9. A thin conductive film such as flexible cable or metal plate is electrically attached to an electrode 15 of each of the vibrators 11 and both ends of film 27 are connected to the common electrodes 26.

Referring again to FIGS. 1 and 2, the holding frame 3, which positions and holds the vibrators 11 and the fixing plate 2, is formed of an epoxy resin or other material in a cylindrical shape having a skirt like portion 31 which fans out at the bottom. The skirt like portion 31, more particularly the interior of the skirt portion 31, receives the respective lead wires 28 and 29, and the head circuit board 9 is mounted onto the bottom of the skirt like portion 31 in a stable manner.

In the drawings, reference numeral 36 designates an inclined guide surface which is formed on holding frame 3 so as to taper toward the positioning hole 33 to facilitate the insertion of the piezoelectric element 1.

Figure 5:
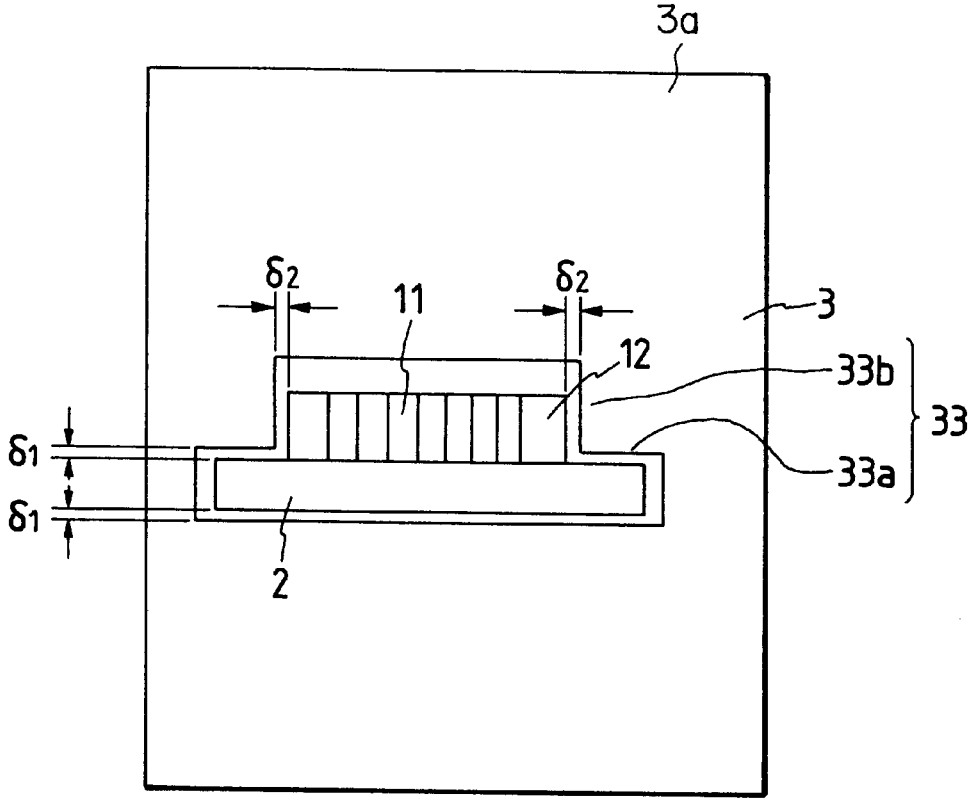
FIG. 5 is a plan view of a positioning hole according to the first embodiment of the invention.

The holding frame 3, which holds the piezoelectric element 1 and the fixing plate 2, has a positioning hole 33 formed in the top surface 32 thereof (see FIGS. 1 and 5). The positioning hole 33 includes a wide portion 33*a* into which the fixing plate 2 can be fitted with a slight clearance $\delta_1$ in the thickness direction thereof, and a narrow portion 33*b* into which the vibrators 11 can be fitted with a slight clearance $\delta_2$ in the width direction thereof. The wide portion 33*a* is used to position the fixing plate 22 in the thickness direction, and the narrow portion 33*b* is used to position the piezoelectric vibrators 11 in the width direction thereof, whereby the piezoelectric vibrators 11 can be accurately positioned in the surface direction of the cavity unit 5. A junction surface 3*a* provided on a top of a holding frame 3 is formed to have high flatness of, i.e., a height variation of 10 $\mu$m or less, and the holding frame 3 has a rigidity higher than the cavity unit 5.

Figure 7:
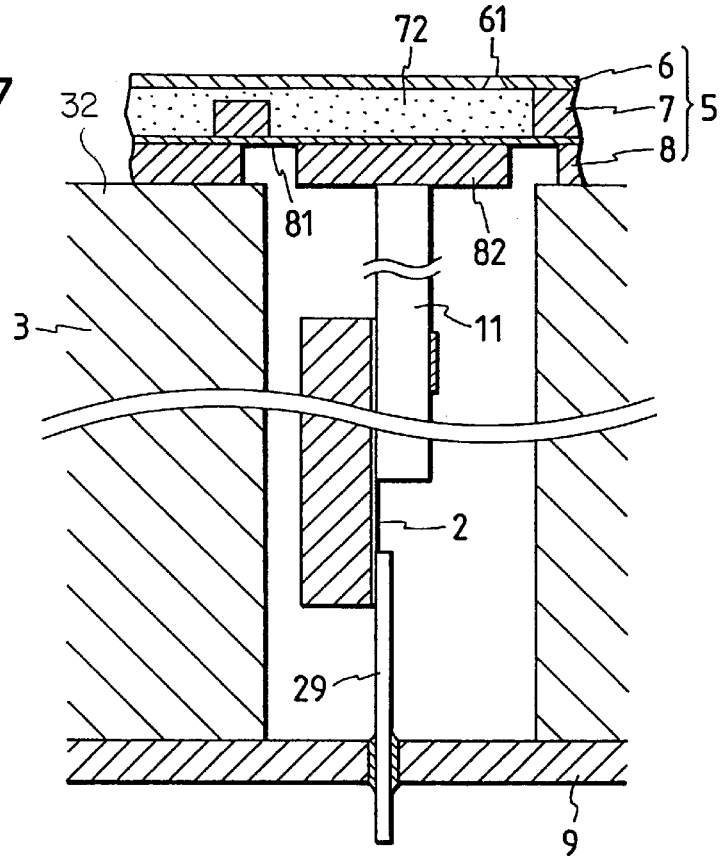
FIG. 7 is a sectional view of main portions of the ink jet recording head.

As illustrated in FIG. 7, the cavity unit 5 is positioned and held on the top surface 32 of a holding frame 3 with a positioning pin 34 (shown in FIG. 2) and includes a nozzle plate 6 having nozzles 61 formed therein, a flow passage plate 7 defining ink flow passages, and an elastic plate 8.

Figure 6:
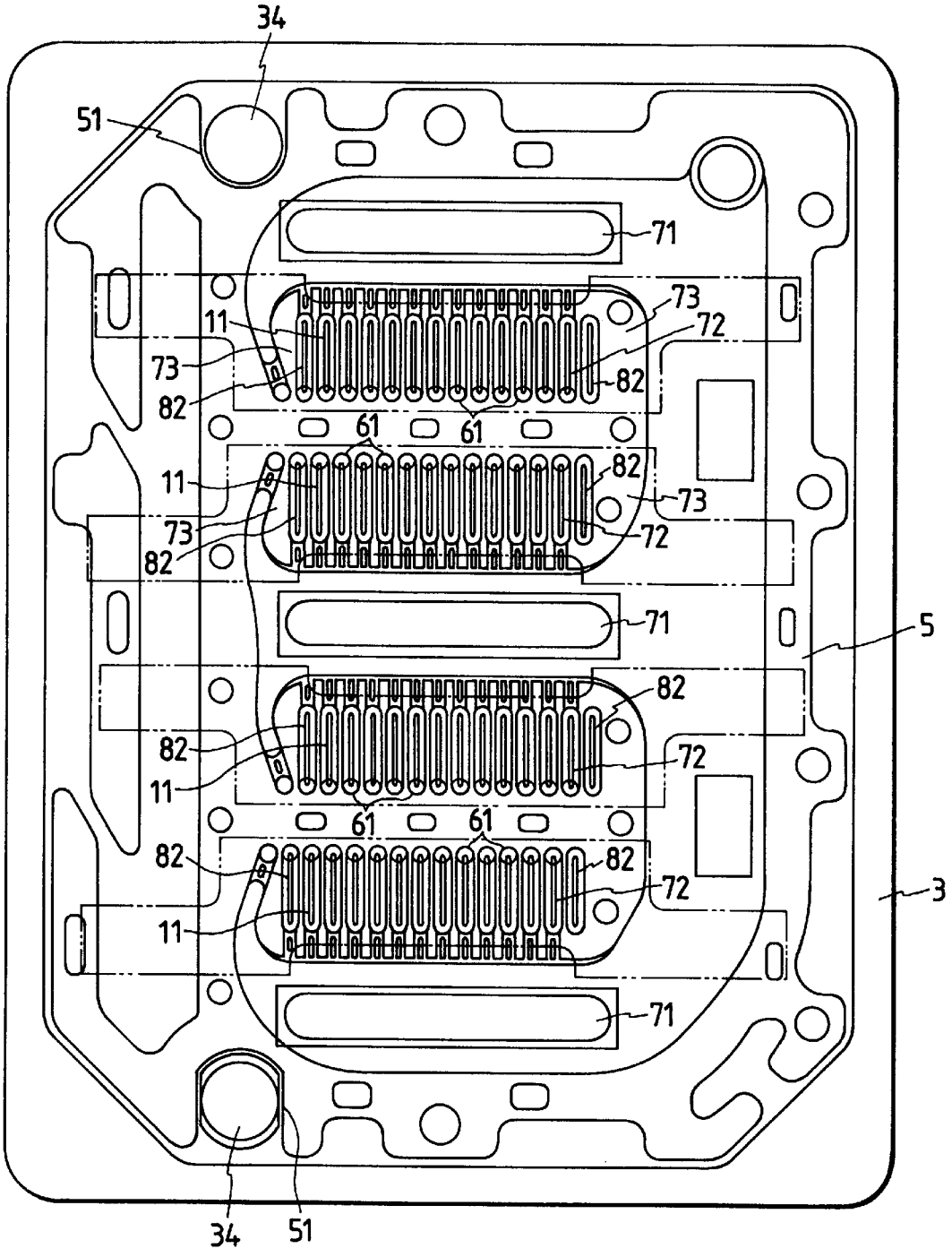
FIG. 6 is a plan view of a cavity unit employed in the preferred embodiments of the invention.

As shown in FIG. 6, the nozzle plate 6 employed in the present embodiment includes two sets of nozzles, each set consisting of two arrays of nozzles, each array consisting of 12 nozzles 61 (only some of which are indicated). It should be noted that the vibrator-positioning members 12 do not have a nozzle associated therewith. Also, the flow passage plate 7 which is formed of a photo-curable resin is placed on the nozzle plate 6. The flow passage plate 7 includes 4 arrays of pressure chambers, each array consisting of 12 pressure chambers 72. Each of the pressure chambers 72, which are formed in a rectangular shape, are in communication with a common ink chamber 71. Specifically, the nozzles 61 are respectively in communication with the ends of the pressure chambers 72 which are disposed to correspond thereto.

Figure 8:
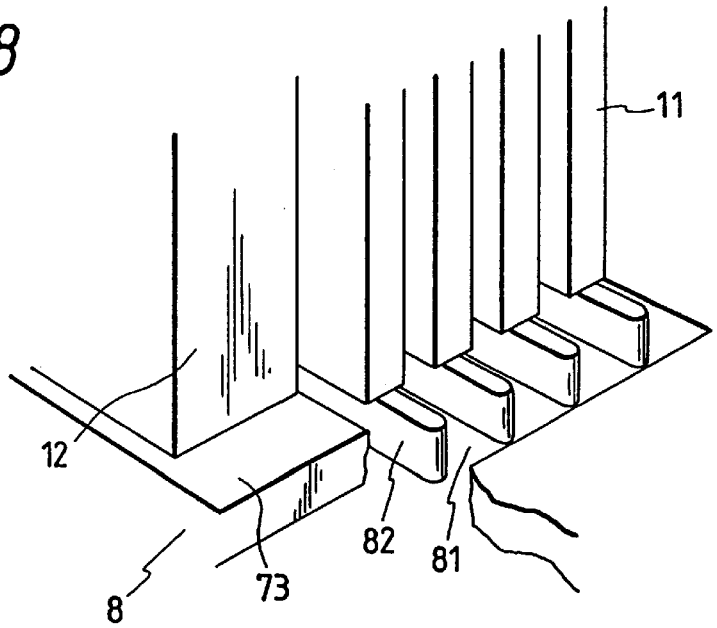
FIG. 8 is a view of a connecting portion between a piezoelectric vibrator and an elastic plate.

Also, the elastic plate 8, which is placed on the surface of the flow passage plate 7, is formed of a thin plate such as an electroforming nickel product or the like. The elastic plate 8 includes a plurality of ring-shaped thin portions 81 which extend along the inner edges of the respective pressure chambers 72. Further, as shown in FIG. 8, in the portions of the elastic plate 8 surrounded by the thin portions 81, there are formed high rigid thick portions 82 which abut against the leading ends of the vibrators 11. Each of the thick portions 82 can be arranged such that it has a width smaller than the thickness of the vibrator 11 (see FIG. 8).

The thin portions 81 and the thick portions 82 can be formed separately from each other. Alternatively, the thick portions 82 may be formed by forming a plating or a resin layer on a thin film constituting thin portions 81.

As shown in FIGS. 2 and 6, recessed or holder portions 51 respectively formed in the cavity unit 5 receive two positioning pins 34 respectively projecting from the top surface of the holding frame 3 to thereby position the cavity unit 5 relative to the holding frame 3 accurately. Also, as shown in FIG. 1, the respective leading ends of the vibrator-positioning members 12 provided on both outermost portions of the vibrators 11 are abutted against flat surfaces 73 of the elastic plate 8 disposed on both sides of the pressure chamber 72 so that the cavity unit 5 and the vibrators 11 are positioned accurately in a direction along which the vibrators 11 are displaced.

In the ink jet recording head constructed in the above-mentioned manner, the piezoelectric element 1 is bonded to the fixing plate 2 such that the front edge of the element 1 projects out to a given length from an edge 23 of the fixing plate 2 (see FIGS. 3(*a*) and 3(*b*)). Subsequently, the piezoelectric element 1 is cut and divided into a large number of portions to thereby provide vibrators 11 and two vibrator-positioning members 12.

Next, the piezoelectric element 1 or fixing plate 2 must be strongly fixed to holding frame 3 by interposing an adhesive in the clearance of the holding frame 3 in order to control the vibratory movements of the fixing plate 2. An epoxy adhesive having an excellent fusing property is desirable when the holding frame is formed of an epoxy resin and the fixing plate 2 is formed of a ceramic materials.

Figure 10:
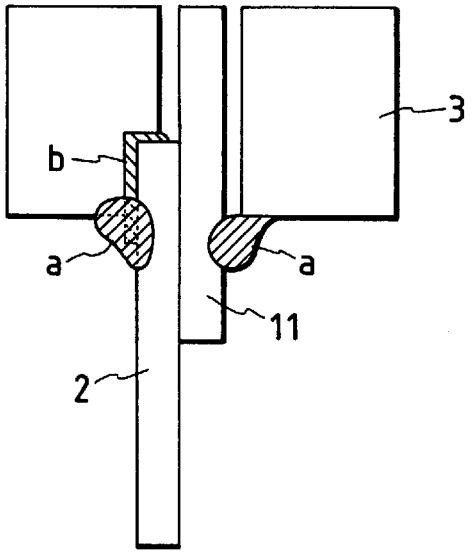
FIG. 10 is a view of a connecting portion between a piezoelectric vibrator, a fixing plate and a holding frame.
Figure 16A:
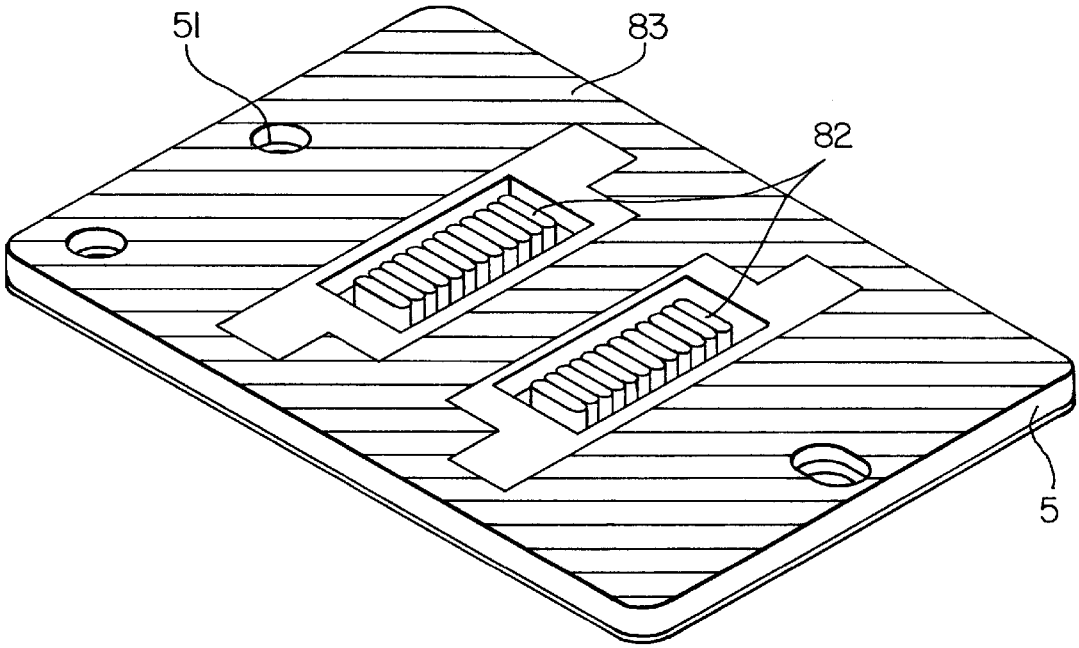
FIGS. 16(*a*) to 16(*c*) illustrate the cavity unit of the first embodiment illustrated in FIGS. 1 and 2.
Figure 16B:
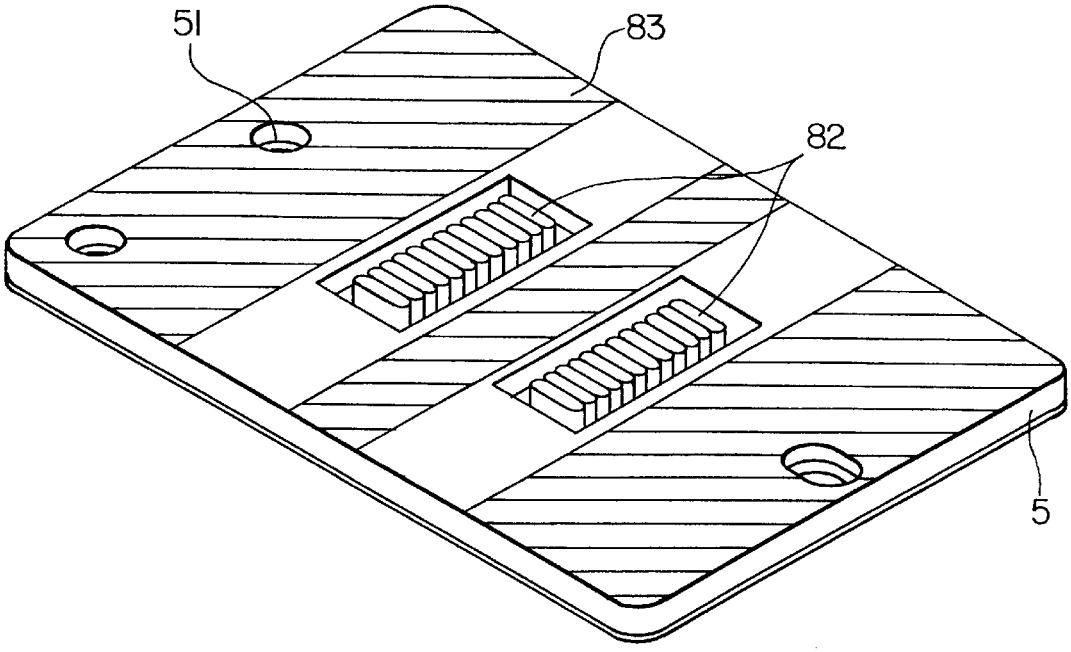
Figure 16C:
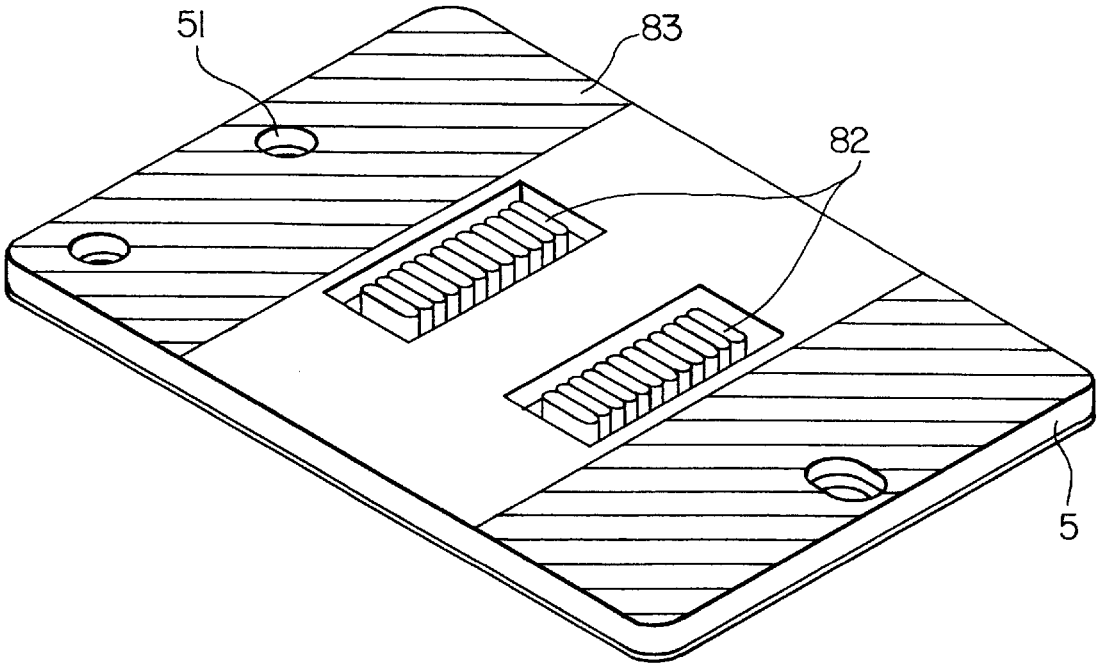

When such an adhesive is heated so that it can be quickly hardened, the leading ends of the vibrators 11 draw back or draw out with reference to the top surface of the holding frame 3 due to the different materials and shapes between vibrators 11, the fixing plate 2, and the holding frame 3. For this reason, in the present embodiment, as shown in FIG. 10, a UV-curing adhesive a is at first coated on the connecting portion as a provisional adhesive. That is, the UV adhesive a is applied to the connecting portion and then is irradiated with ultraviolet rays to be hardened. Subsequently, an epoxy adhesive b is injected between the holding frame 3 and the fixing plate 2 to thereby firmly bond the fixing plate 2 to the holding frame 3 under relatively low temperature or even room temperature. The cavity unit 5 is then mounted in such a manner that the recessed portions 51 thereof are engaged with the respective positioning pins 34 projecting from the holding frame 3. At this time, the cavity unit 5 and the holding frame 3 are fixed with each others as shown in FIGS. 16(*a*) to 16(*c*), are fixed to each other in an area represented by a hatched portion 83 except for an area of the elastic plate 8 which is proximate the plurality of pressure chambers 72 of the cavity unit 5.

With such a construction, any warp or other deformation of the cavity unit 5 is eliminated by the contact with the fixed surface 3*a* of the holding frame 3 which has a higher rigidity than cavity unit 5 and a flat surface thereon which has the above-noted high degree of flatness. Therefore, the thick portion, 82 of the elastic plate 8 and the vibrators 11 are accurately bonded to each other, and also the cavity unit 5 is restrained from being deformed due to pressure supplied from the pressure chambers. In this embodiment, a photo-curable resin was used as the material of the flow passage plate 7 of the cavity unit 5. However, the same advantage is obtained if the flow passage plate 7 is formed through a plastic molding injection process.

Next, the two vibrator-positioning members 12 are fitted into the positioning hole 33 formed in the top surface 32 of the holding frame 3 to thereby position the vibrators 11 in the widthwise direction thereof. At the same time, the vibrators 11 are positioned in the thickness direction thereof by means of the fixing plate 2. Further, the respective leading end portions of the vibrator-positioning members 12 are abutted against the flat surface 73 provided on both sides of each pressure chambers array on the elastic plate 8, thereby positioning the vibrators 11 and the cavity unit 5 in the displacement direction thereof.

Figure 9:
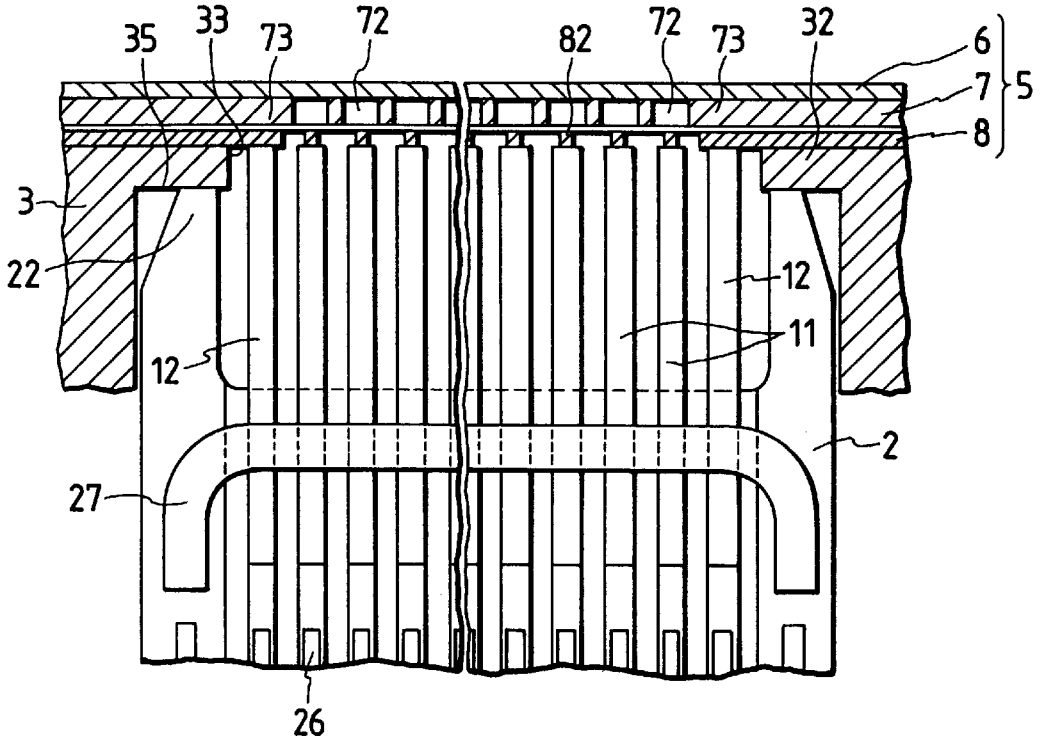
FIG. 9 is a sectional view of the ink jet recording head according to a second embodiment of the invention.

FIG. 9 illustrates another embodiment of the invention, which relates to the positioning of the vibrators 11 and the cavity unit 5 in the displacement direction. In this embodiment, instead of the vibrator-positioning members 12 used in the above-mentioned embodiment, the positioning members 22 on the leading end of the fixing plate 2 are abutted against a positioning step 35 of the holding frame 3 so that the vibrators 11 are positioned in the displacement direction with accuracy.

Figure 11:
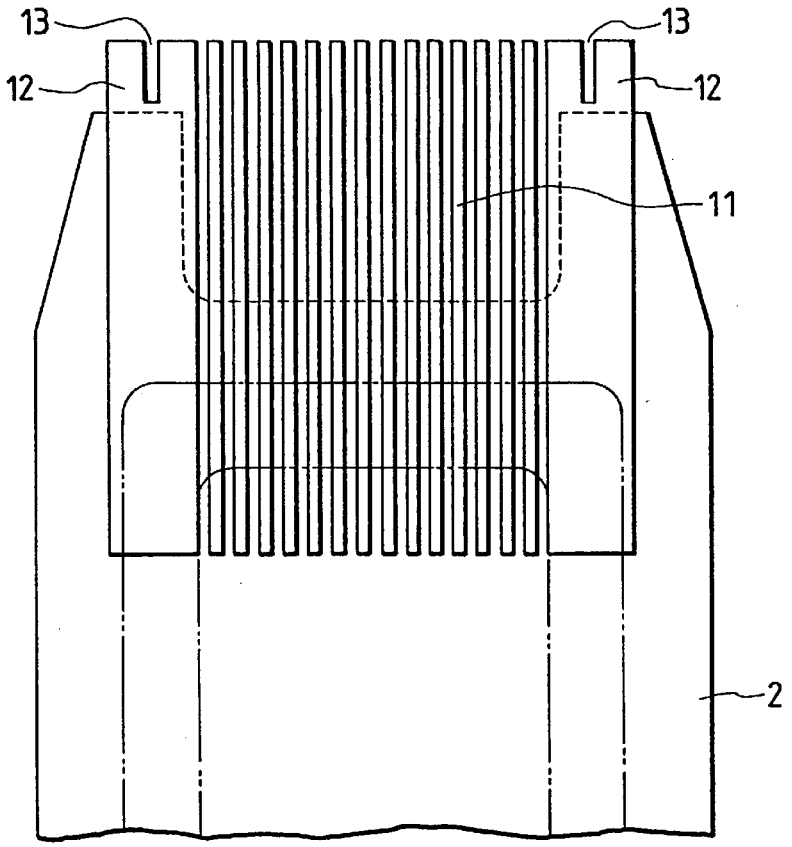
FIG. 11 is a plan view of a piezoelectric vibrator according to third embodiment.

FIG. 11 illustrates a third embodiment of the invention, which relates to the mutual positioning of the vibrators 11 and the cavity unit 5. In this embodiment, the widths of the vibrator-positioning members 12 to be provided on the two outermost sides of the vibrators 11 are widened and slits 13 are formed at predetermined positions with reference to the vibrators in the leading end faces thereof, so that positioning pins provided on the lower surface of the elastic plate 8 can be fitted respectively into the slits 13.

According to the third embodiment, the vibrators 11 and the cavity unit 5 are directly connected to each other to thereby enhance their mutual positioning accuracy in the surface direction.

Figure 12:
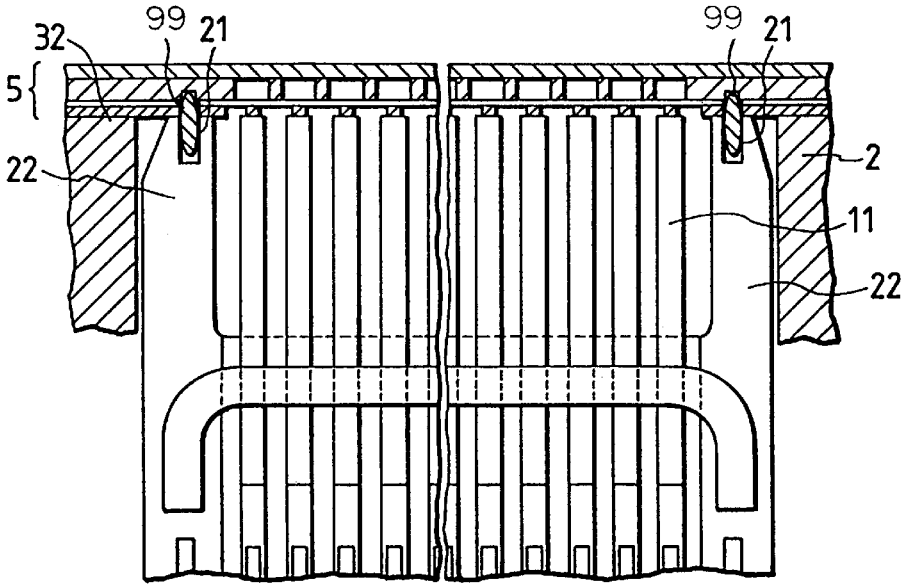
FIG. 12 is a section view of the ink jet recording head according to fourth embodiment.

FIG. 12 illustrates a fourth embodiment, which relates to the positioning of the vibrators 11 and cavity unit 5. In the fourth embodiment, the front edge of a plate-shaped piezoelectric element 1 is arranged so as to project a distance which corresponds to the leading ends of two positioning portions 22 provided on the two sides of a fixing plate 2, and then the piezoelectric element 1 and the fixing plate 2 are bonded to each other. Subsequently, the piezoelectric element 1 is cut and divided into a large number of vibrators 11, so that the leading ends of the respective vibrators 11 can be matched to the leading ends of positioning portions 22 with accuracy.

According to this embodiment, the vibrators 11 are positioned in a surface direction by cooperation between slit 21 and pin 99, and positioned in the surface direction, placing ends of the positioning portions 22 in contact with the elastic plate 8.

Figure 13:
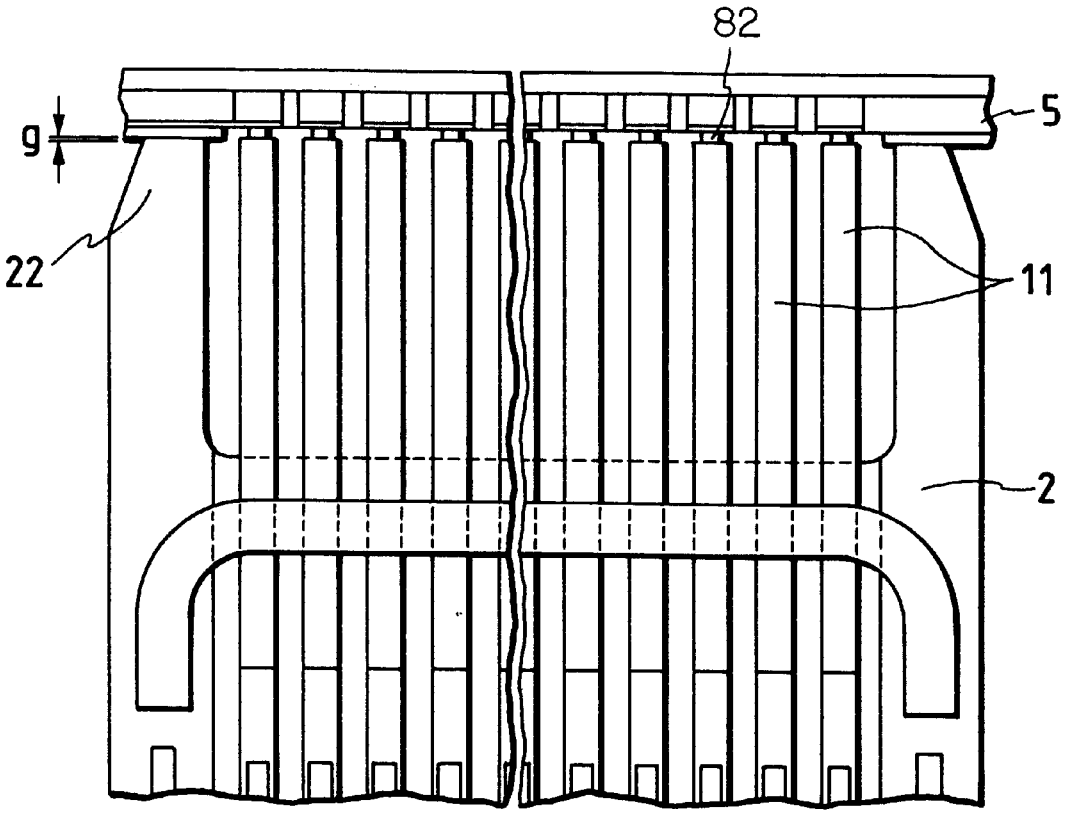
FIG. 13 is a sectional view of a fifth embodiment of an ink jet recording head according to the invention.

FIG. 13 illustrates a fifth embodiment of the invention in which the front edge of a piezoelectric element 1 is projected out a slight length g beyond the leading ends of two positioning portions 22 respectively provided on the two side portions of a fixing plate 2 and then the piezoelectric element 1 and fixing plate 2 are bonded to each other. Subsequently, the piezoelectric element 1 is cut and divided into a large number of vibrators 11. According to the fifth embodiment, when a cavity unit 5 is mounted to the leading ends of the two positioning portions 22, which function as a reference for positioning, on the two side portions of the fixing plate 2, then the leading ends of the vibrators 11 are strongly abutted against an elastic plate 8 in such a manner that the elastic plate a is slightly flexed toward a pressure chamber 72. Accordingly, the thickness. of an adhesive to be applied to the leading ends of the vibrators 11 can be reduced. Alternatively, the adhesive may be omitted.

Figure 14A:
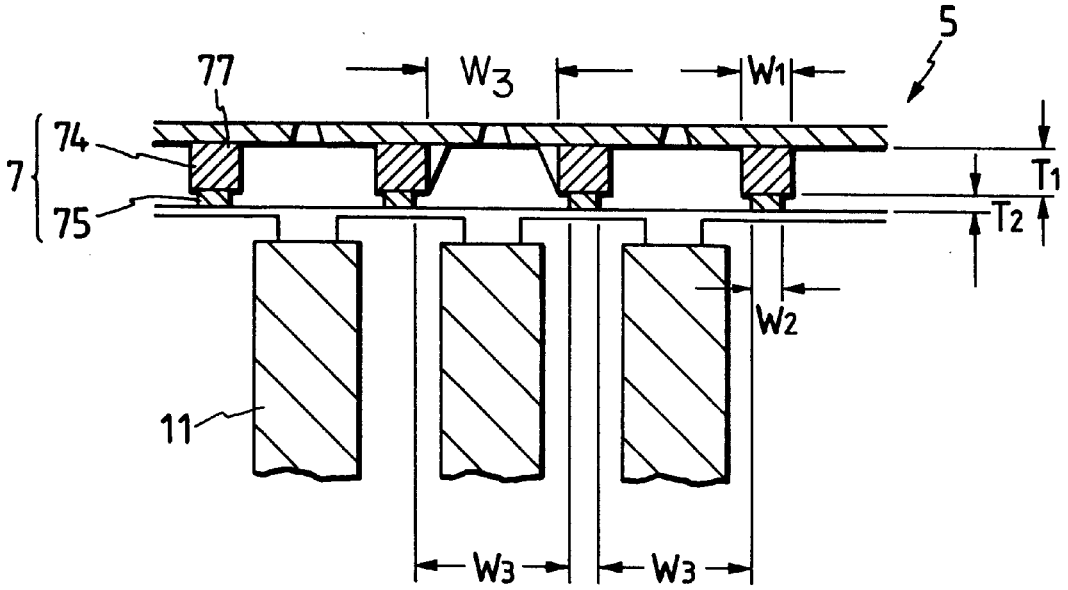
FIGS. 14(*a*) and 14(*b*) are sectional views of a sixth embodiment of a cavity unit.
Figure 14B:
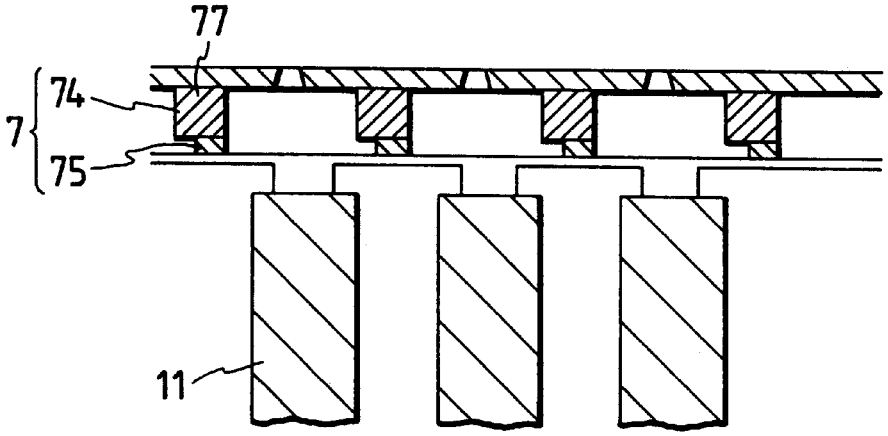

FIGS. 14(*a*) and 14(*b*) illustrate a sixth embodiment of a cavity unit 5 according to the invention. In the sixth embodiment, the chamber partition wall 77 of the flow passage plate 7, which defines an ink flow passage, is composed of a thick layer 74 and a thin layer 75, and the thick layer 74 is arranged to have a wide width W1 and the thin layer 75 is arranged to have a narrow width W2.

According to the sixth embodiment, even if the two layers 74 and 75 are slightly shifted in position in the surface direction thereof when they are connected together in the manufacturing process, as shown in FIG. 14(*b*), the area of the connecting surface thereof remains unchanged so that the rigidity of the wall 77 can be maintained. Also, by uniformly setting a ratio T/W of the thicknesses T1 ,T2 and widths W1, W2 of the two layers 74, 75, the rigidity is enhanced to thereby ensure stable ink jetting.

This embodiment also allows a wide span W3 of the pressure chamber without decreasing a rigidity of wall, and thus a large volume ink droplet can be produced, even in the case of high density pressure chamber.

Figure 15:
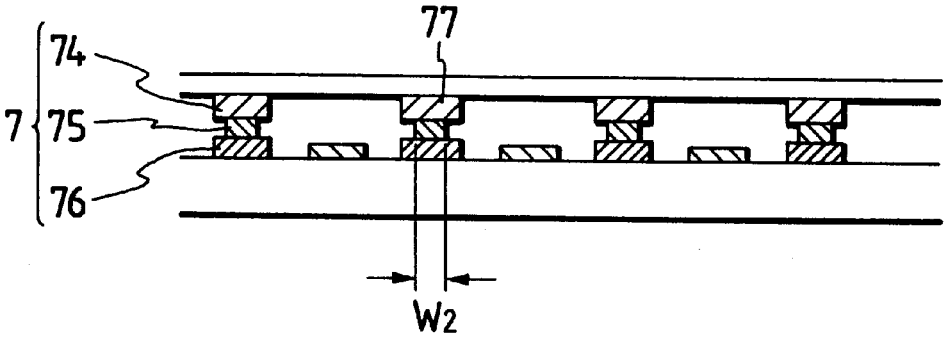
FIG. 15 is a sectional view of a seventh embodiment of a cavity unit.

FIG. 15 illustrates a seventh embodiment in which a flow passage plate 7 is composed of three layers 74, 75, 76, and the width W2 of the middle layer 75 is set narrower than those of the remaining layers. Accordingly, even if the three layers are shifted in the surface direction thereof when they are connected together, the strength and rigidity of the wall can be maintained constant.

The invention has been described through preferred embodiments thereof. However, it will, be apparent to those skilled in the art that various modifications can be made without departing from the scope of the invention as defined by the appended claims.

What is claimed is:

1. An ink jet recording head, comprising:

a fixing plate;

a plurality of piezoelectric vibrators fixed to said fixing plate in a row; and positioning members disposed at opposite ends of said row of vibrators outside of the outermost ones of said vibrators in a direction in which said vibrators are arranged in the row, said positioning members being fixed to said fixing plate, wherein said positioning members are piezoelectric elements that do not contribute to ejection of ink.

2. An ink jet recording head as recited in claim 1, further comprising:

a holding frame to which said fixing plate is attached; and a cavity unit including a plurality of pressure chambers, nozzle openings communicating with said pressure chambers, and a vibrating plate for propagating vibrations from said vibrators to said pressure chambers.

3. An ink jet recording head as recited in claim 2, wherein said cavity unit is fixed to said holding frame at portions of said cavity unit on one or more sides of said pressure chambers, not including portions of said cavity unit that oppose said pressure chambers.

4. An ink jet recording head as recited in claim 3, wherein said portions of said holding frame that are fixed to said cavity unit are substantially flat surfaces.

5. An ink jet recording head as recited in claim 4, wherein said substantially flat surfaces have a height variation of 10 $\mu$m or less.

6. An ink jet recording head as recited in claim 2, wherein said cavity unit comprises a flow passage plate, and said flow passage plate is made of photosensitive resin.

7. An ink jet recording head as recited in claim 2, wherein said cavity unit comprises a flow passage plate, and said flow passage plate is formed by plastic injection molding.

8. An ink jet recording head as recited in claim 2, wherein said vibrators are arranged at equal intervals, leading ends of said vibrators are aligned with each other, and said vibrators form a plurality of vibrator groups which are set in said cavity unit simultaneously.

9. An ink jet recording head as recited in claim 1, wherein said vibrators are arranged at equal intervals, and leading ends of said vibrators are aligned with leading ends of said positioning members.

10. The ink jet recording head recited in claim 1, wherein said positioning members have the same construction as said vibrators but have a different size than said vibrators.

11. The ink jet recording head recited in claim 1, wherein said vibrators and said positioning members have end surfaces that contact said fixing plate, and said end surfaces are disposed in a single plane.

* * * * *